United States Patent [19]

Marino

[11] Patent Number: 4,966,292

[45] Date of Patent: Oct. 30, 1990

[54] CAP AND NECK FINISH FOR A WIDE MOUTH CONTAINER

[75] Inventor: Michael Marino, New Castle, Pa.

[73] Assignee: West Penn Plastics, Inc., New Castle, Pa.

[21] Appl. No.: 424,916

[22] Filed: Oct. 23, 1989

[51] Int. Cl.[5] ..... B65D 17/40

[52] U.S. Cl. ..... 215/256; 220/270; 220/276

[58] Field of Search ..... 215/256; 220/270

[56] References Cited

U.S. PATENT DOCUMENTS

| | | | |
|---|---|---|---|
| 3,608,765 | 9/1971 | Faulstich | 215/256 |
| 3,940,004 | 2/1976 | Faulstich | 215/256 |
| 4,438,857 | 3/1984 | Bullock, III | 215/256 |
| 4,625,876 | 12/1986 | Bullock, III | 215/256 |
| 4,691,834 | 9/1987 | Bullock, III | 215/256 X |
| 4,798,301 | 1/1989 | Bullock | 215/256 |
| 4,801,032 | 1/1989 | Crisci | 215/256 |
| 4,903,849 | 2/1990 | Wallman | 215/256 |

*Primary Examiner*—Stephen Marcus
*Assistant Examiner*—Nova Stucker
*Attorney, Agent, or Firm*—Harpman & Harpman

[57] ABSTRACT

A cap of the type having a top portion with a depending annular flange on its peripheral edge and a depending annular sealing flange inwardly thereof between which the neck of the container is sealingly engaged is disclosed in which an annular depending flange of the cap has a lower annular portion offset outwardly for registry with a similarly shaped neck finish of the container. An upstanding tab is integrally formed on the lower annular portion of the depending annular flange. The inner surface of the annular depending flange and the outer surface of the neck finish have cooperating upper and lower locking ribs and grooves holding the cap in place until a major portion of the depending annular flange and its lower annular offset portion are removed by tearing along a horizontal frangible line which removes the lower cap locking rib. The horizontal frangible line has a depending portion adjacent the upstanding tab and a downwardly curving frangible line extends therefrom to the lower edge of the lower annular offset portion. The removable portion of the depending annular flange and the lower annular offset portion form a tear skirt which must be removed from the neck finish of the container in order to remove the cap therefrom. A downturned tab is formed on the remaining portion of the depending annular flange to provide for easy engagement by the finger of the user.

5 Claims, 1 Drawing Sheet

CAP AND NECK FINISH FOR A WIDE MOUTH CONTAINER

BACKGROUND OF THE INVENTION

1. Technical Field:

This invention relates to so-called wide mount containers and closures therefor of the tamper-resistant type.

2. Description of the Prior Art:

Prior devices of this type may be seen in U.S. Pat. Nos. 3,940,004, 4,438,857, 4,625,876, 4,691,834 and 4,798,301. In each of these patents, caps formed of plastic material that is somewhat resilient and deformable are provided for containers of a similar plastic material, such containers and caps are relatively inexpensive and generally considered expendible.

One of the major problems with the prior art devices has resided in the tamper indicting constructions which are sometimes accidentally opened or partially removed resulting in the inability of the product in the container to be sold and the damage that occurs when the product in the container is accidentally released as in shipment.

The present invention provides a cap and a neck finish for a wide mouth container, for example a 110 mm wide mouth container, and provides positive engagement of the cap on the neck finish of the wide mouth container during shipping and handling and at the same time provides a relatively simple easy to use tear skirt construction facilitated by a tear tab and at the same time leaving a convenient finger engaging secondary tab which is quite useful when the cap is replaced on the container.

SUMMARY OF THE INVENTION

A cap and a neck finish for a wide mouth container forms a dependng annular flange on the top of the cap with an outwardly offset lower annular flange with a horizontal frangible tear line in the upper portion of the depending annular flange and substantially above the lower annular outwardly offset protion. An upstanding tab is formed on the lower annular outwardly offset flange and a portion of the horizontal frangible tear line is positioned adjacent the lower annular outwardly offset portion adjacent the tab to form a secondary tab. A frangible tear line extends from the lower section of the horizontal tear line to the lower edge of the cap and may be seen when the tab and the tear skirt defined by the horizontal frangible tear line is removed. The inner surface of the depending annular skirt and the lower annular outwardly offset portion thereof have locking ribs thereon engaging cooperating locking ribs and grooves in the neck finish of the container.

DESCRIPTION OF THE PREFERRED EMBODIMENT

This invention relates to a new and improved tamper evident cap and a neck finish for a container for receiving the same as applied to a wide mouth container.

Figure 1:
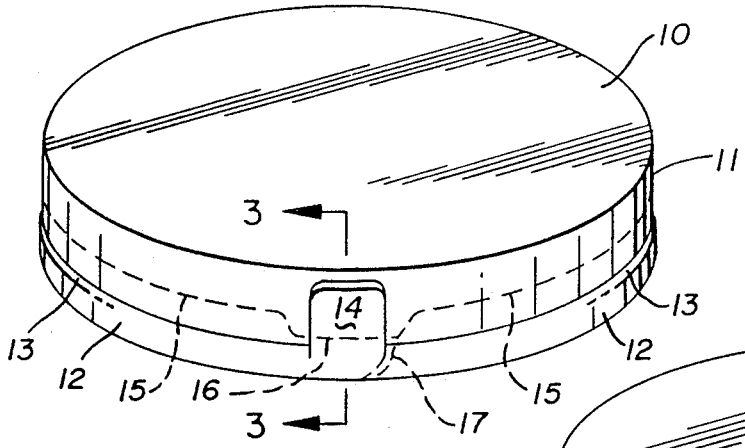
FIG. 1 is a perspective elevation of the cap of the present invention.

By referring to FIG. 1 of the drawings, it will be seen that the cap has a top portion 10 with a depending annular flange 11 on the periphery thereof. The lower portion of the depending annular flange 11 takes the form of a lower annular outwardly offset secondary flange 12, the junction between the upper portion 11 of the depending annular flange and the secondary flange 12 comprising an outward and downward curving section 13.

Figure 3:
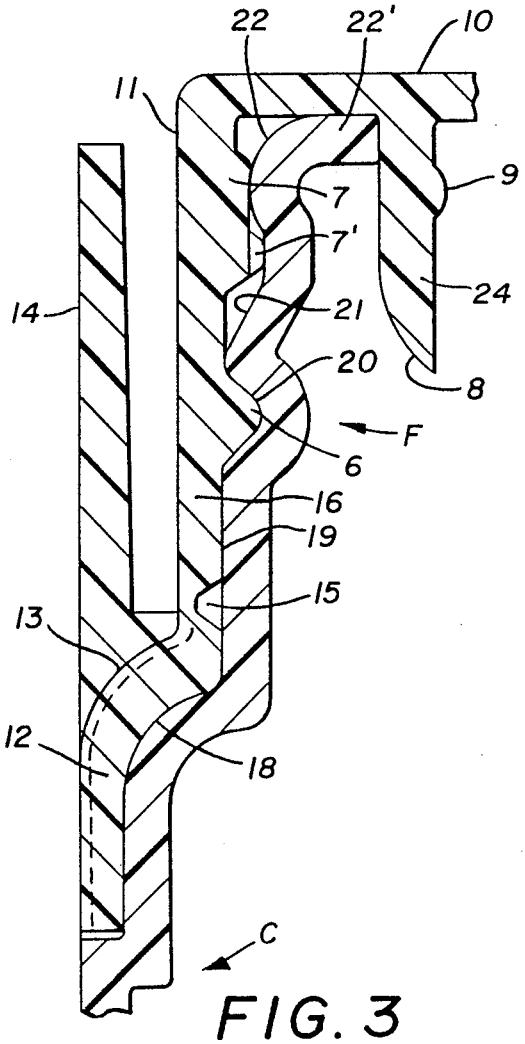
FIG. 3 is an enlarged vertical section of the cap on line 3—3 of FIG. 1 positioned on the neck finish of a container.

An upstanding pull tab 14 is integrally formed with the secondary flange 12 so as to extend upwardly from the outwardly and downwardly curving section 13 thereof as best seen in FIGS. 1 and 3 of the drawings.

Figure 2:
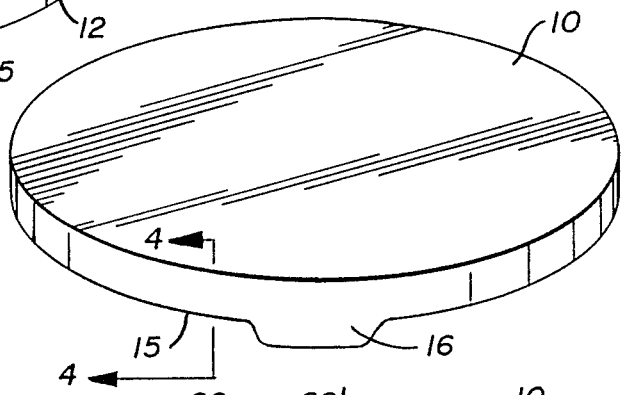
FIG. 2 is a perspective elevation of the cap following the removal of the tear skirt therefrom.

Referring again to FIG. 1 of the drawings, it will be seen that a horizontal frangible tear line 15 extends circumferentially around the depending annular flange 11 substantially above the outward and downward curving section 13 from which the secondary flange 12 depends with the exception that in the area of the depending annular flange 11 adjacent the upstanding tear tab 14, the frangible tear line 15 takes a lower position for a short distance so as to define a downturned secondary tab 16 as best seen in FIG. 2 of the drawings. A curving frangible line 17 extends from the section of the horizontal frangible line 15 beside the tear tab 14 to the lowermost edge of the secondary flange 12. It will be seen that grasping the tear tab 14 and moving it outwardly with respect to the depending annular flange 11 will tear the portion of the depending annular flange 11 below the horizontal frangible tear line 15 including the secondary flange 12 from the cap leaving the upper portion of the cap as illustrated in FIG. 2 of the drawings.

In FIG. 2 of the drawings, it will be seen that the remaining portion of the cap comprises the top 10 with the upper portion of the depending annular flange 11 thereon and includes the depending secondary tab 16 which facilitates removing the remaining cap portion from the container either originally or when it has been repositioned thereon.

By referring now to FIG. 3 of the drawings, it will be seen that a container C such as a blow molded polyethylene or similar plastic material bottle or jar is partially illustrated with a neck finish F formed as a cylindrical upper end with an outer surface including an upwardly and inwardly curving section 18, a vertical smooth surface 19 extending thereabove, an inwardly extending concave section 20 defining an anular groove of a known diameter in the outer surface thereof, an inwardly an upwardly angled section 21 thereabove ending in a flat outer surface of a diameter the same as said annular groove and a convex outer surface 22 which continues into a horizontal inturned flange 22', the uppermost portion of the horizontally disposed inturned flange 22' of the neck finish F being in sealing engagement with the lower surface of the top portion 10 of the cap with the innermost surface of the horizontal inturned flange 22' abutting a depending annular sealing flange 24 on the lower surface of the top portion 10 of the cap, the depending sealing flange 24 being spaced inwardly from the depending annular flange 11 of the cap of the invention. An annular rib 9 is formed on the inner surface of the annular depending sealing flange 24 to increase the rigidity thereof and preferably the lower outer surface 8 of the annular depending sealing flange 24 is curved inwardly and downwardly to facilitate positioning the cap of the invention on the neck finish F of the container.

Still referring to FIG. 3 of the drawings, it will be seen that an annular relatively wide flattened rib 7 and a lower vertically spaced smaller rib 6 are formed on the inner surface of the depending annular flange 11 and that several circumferentially extending partial ribs 7' are formed on the inner annular surface of the relatively wide annular rib 7. The relatively wide annular rib 7 and the plurality of smaller ribs 7' thereon and the annular rib 6 form upper and lower fastening configurations on the cap of the invention.

Still referring to FIG. 3 of the drawings, it will be seen that the horizontal frangible tear line 15 hereinbefore described is shown as a weakened area 15 in the depending annular flange 11 being illustrated in the lowermost position thereof where it forms the lower edge of the secondary tab 16 hereinbefore described and disclosed in FIGS. 1 and 2 of the drawings.

Figure 4:
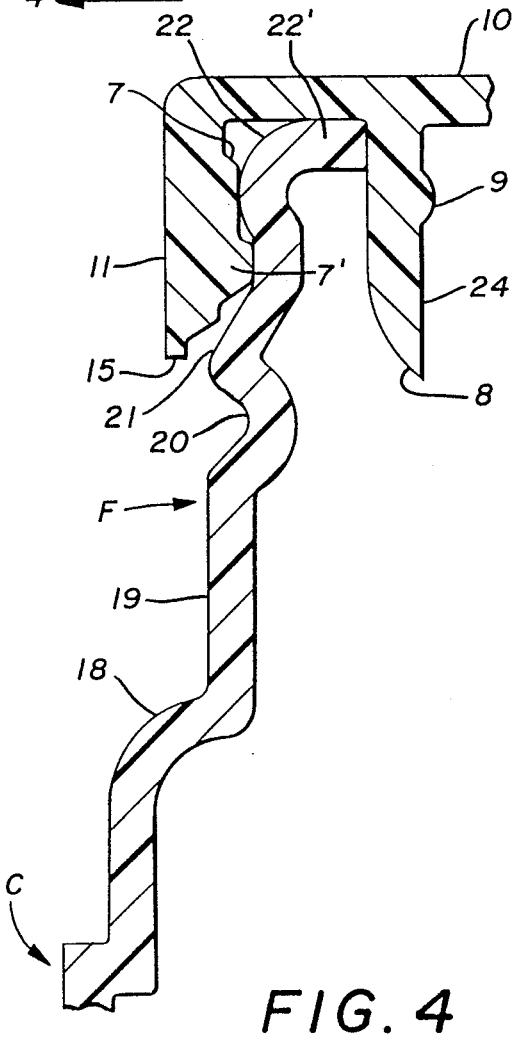
FIG. 4 is an enlarged vertical-section of the portion of the cap of FIG. 2 on line 4—4 thereof positioned on the neck finish of the container.

It will occur to those skilled in the art that when the tear tab 14 is grasped and used to tear the tear skirt from the original cap structure, the remaining cap structure as seen in FIG. 2 of the drawings and best illustrated in FIG. 4 of the drawings in the sectional elevation thereof still retains two fastening configurations comprising the relatively wide annular rib 7 on the inner surface of the depending annular flange 11 and the smaller sectional inturned ribs 7' formed thereon, the wider rib 7 engaging the convex outer surface 22 of the neck finish F and the smaller ribs 7' engaging the area of smaller diameter of the neck finish therebelow, all as best illustrated in FIG. 4 of the drawings.

It will be seen that the relatively wide annular rib 7 on the inner surface of the depending annular flange 11 of the cap provides a positive frictional fastening engagement with the convex outer section 22 of the neck finish F for the reason that the horizontal inturned flange 22' of the finish F is engaged firmly against the outer surface of the annular depending sealing flange 24 of the cap and the several, preferably three circumferentially extending partial ribs 7' formed inwardly of the relatively wide annular rib 7 selectively engage the area of smaller diameter of the neck finish F immediately below the annular convex section 22 of the neck finish F. The result is a positive fastening and sealing engagement due to the multiple portions of the cap and the neck finish engaging one another all in the uppermost portion of the annular depending flange 11 which as seen in FIG. 4 of the drawings remains on the upper portion of the cap of the invention when it is reapplied to the neck finish of the container.

It will thus be seen that a cap can neck finish for a wide mouth container disclosed herein forms both a tamper indicating combination and a child-resistant closure and container assembly and having thus described our invention, what we claim is:

1. A cap and neck finish for a wide mouth container comprising in combination a container neck having a cap receiving finish, said finish formed with a cylindrical upper end having an outer surface including a convex outer surface and an inturned flange extending therefrom, a flat outer surface immediately below said convex outer surface, an outwardly and downwardly angled outer surface therebelow, an annular groove in said outer surface immediately below said outwardly and downwardly angled outer surface, a vertical smooth surface below said annular groove and an outturned and downturned outer surface therebelow joining said container; and a deformable flexible plastic cap, said cap having a top portion having a depending annular flange on its peripheral edge and a depending annular sealing flange inwardly thereof, the space between said depending annular flange and said depending annular sealing flange being such that said convex outer surface of said neck finish and its inturned flange 22' are sealingly engaged in said cap when positioned therein, a flattened rib on the inner surface of said depending annular flange of said cap for sealing engagement with said convex outer surface of said neck finish, several circumferentially spaced inturned rib sections on said flattened rib positioned for engagement with said flat outer surface immediately below said convex outer surface of said neck finish and an inturned cross sectionally curved rib on the inner surface of said depending annular flange therebelow for fastening registry in said annular groove is said neck finish and an area of weakness in said depending annular flange above said curved rib extending therearound on a first horizontal line and a portion of said area of weakness being spaced below said horizontal area of weakness and communicating therewith so as to form a downturned tab configuration; a lower annular outwardly offset secondary flange defining the lower portion of said downturned annular flange for registry with said outturned and downturned outer surface of said neck finish; an upstanding pull tab on said secondary flange; an upward extending weakened area in said secondary flange adjacent said upstanding pull tab.

2. The combination of claim 1 in which said convex outer surface of said cylindrical upper end of said finish is of a known diameter and the diameters of said flat outer surface and said annular groove of said finish are equal and less than the known diameter of said convex outer surface.

3. The combination of claim 1 in which said convex outer surface of said cylindrical upper end of said finish is of a known diameter and the diameters of said flat outer surface and said annular groove of said finish are equal and less than the known diameter of said convex outer surface and wherein the diameter of said outturned and downturned outer surface of said finish is greater than said known diameter of said convex outer surface of said finish.

4. A deformable flexible plastic cap for use with a container neck having a cap receiving finish, said cap comprising a top portion having a depending annular flange on its periphery and a depending annular sealing flange inwardly thereof, a flattened rib on the inner surface of said depending annular flange having an upper edge spaced with respect to said top portion, a plurality of circumferentially spaced inturned rib sections on said flattened rib spaced downwardly with respect to said upper edge thereof, said flattened rib forming a thickened area in said depending annular flange, said rib sections increasing the thickness of said flattened rib, a lower annular outwardly offset secondary annular flange forming a lower portion of said depending annular flange; an annular rib on the inner surface of said depending annular flange between said flattened rib and said lower annular outwardly offset secondary flange; an area of weakness in said depending annular flange of said cap extending substantially therearound on a horizontal line with a section of said area of weakness being spaced below said horizontal area of weakness and communicating therewith so as to form a downturned tab configuration; an upstanding pull tab on said lower annular outwardly offset secondary flange and an upward area of weakness in said secondary flange communicating with said section of weakness spaced below said horizontal line and positioned adjacent said upstanding pull tab whereby moving said pull tab outwardly and away from said cap removes an annular portion of said depending annular flange and the annularly offset secondary flange and said annular rib.

5. The deformable flexible plastic cap of claim 4 and wherein an annular rib is formed on the inner surface of the annular depending sealing flange to increase the rigidity thereof.

* * * * *